US007369782B2

(12) United States Patent
Adkins et al.

(10) Patent No.: US 7,369,782 B2
(45) Date of Patent: May 6, 2008

(54) METHOD AND SYSTEM FOR PROVIDING TECHNICAL SUPPORT RELATING TO AN IMAGING CARTRIDGE

(75) Inventors: Christopher A. Adkins, Lexington, KY (US); George Chausanski, Lexington, KY (US); Jeffrey R. Ehlert, Lexington, KY (US); Douglas K. Peterson, Jr., Irvine, KY (US); Timothy L. Strunk, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 276 days.

(21) Appl. No.: 10/940,258

(22) Filed: Sep. 14, 2004

(65) Prior Publication Data

US 2006/0056856 A1 Mar. 16, 2006

(51) Int. Cl.
*G03G 15/00* (2006.01)

(52) U.S. Cl. ..... 399/8; 399/9

(58) Field of Classification Search ..... 399/8, 399/9

See application file for complete search history.

(56) References Cited

U.S. PATENT DOCUMENTS

| | | | | |
|---|---|---|---|---|
| 5,455,606 | A | 10/1995 | Keeling et al. | 347/7 |
| 5,455,608 | A | 10/1995 | Stewart et al. | |
| 5,887,216 | A | 3/1999 | Motoyama | 399/8 |
| 6,039,430 | A | 3/2000 | Helterline et al. | 347/19 |
| 6,040,921 | A | 3/2000 | Hayashi et al. | 358/434 |
| 6,141,507 | A | 10/2000 | Sawada | 399/8 |
| 6,233,408 | B1 * | 5/2001 | Allen | 399/8 |
| 6,238,112 | B1 | 5/2001 | Girones et al. | |
| 6,298,457 | B1 | 10/2001 | Rachlin et al. | 714/49 |
| 6,314,249 | B1 | 11/2001 | Lay et al. | 399/11 |
| 6,345,891 | B1 | 2/2002 | Childers et al. | |
| 6,415,392 | B1 | 7/2002 | Suzuki et al. | 714/27 |
| 6,431,673 | B1 | 8/2002 | Heim et al. | |
| 6,447,091 | B1 | 9/2002 | Calvo et al. | |
| 6,516,427 | B1 | 2/2003 | Keyes et al. | 714/25 |
| 6,549,732 | B2 * | 4/2003 | Yoshizaki et al. | 399/12 |
| 6,564,227 | B2 | 5/2003 | Sakakibara et al. | 707/104.1 |
| 6,565,179 | B1 | 5/2003 | Bruch et al. | |
| 6,625,402 | B2 | 9/2003 | Takemoto | 399/8 |
| 6,687,634 | B2 | 2/2004 | Borg | 702/85 |
| 6,707,567 | B1 | 3/2004 | Suzuki | 358/1.15 |
| 6,795,829 | B2 | 9/2004 | Alsop et al. | 707/102 |
| 2003/0023703 | A1 * | 1/2003 | Hayward et al. | 709/217 |

FOREIGN PATENT DOCUMENTS

JP 2004120458 A * 4/2004

OTHER PUBLICATIONS

Lexmark T420 User's Guide T420, Jun. 2002, pp. 96-110, availible at http://www.lexmark.com/publications/pdfs/lexmarkt420/eng/useref.pdf.*

* cited by examiner

*Primary Examiner*—David M. Gray
*Assistant Examiner*—Ryan Gleitz
(74) *Attorney, Agent, or Firm*—Taylor & Aust, PC

(57) ABSTRACT

A method for providing technical support to a customer relating to an imaging cartridge used in an imaging apparatus includes receiving a request from the customer for assistance relating to the imaging cartridge; executing diagnostic software associated with a type of the imaging apparatus based on the request to generate a diagnostic code pertaining to the imaging cartridge; receiving the diagnostic code from the customer; performing an analysis of the diagnostic code; and determining an action to be taken based on the analysis of the diagnostic code.

20 Claims, 9 Drawing Sheets

100

METHOD AND SYSTEM FOR PROVIDING TECHNICAL SUPPORT RELATING TO AN IMAGING CARTRIDGE

BACKGROUND OF THE INVENTION

1. Field of the Invention

The present invention relates to an imaging apparatus, and, more particularly, to a method and system for providing technical support relating to an imaging cartridge used in an imaging apparatus.

2. Description of the Related Art

In recent years, the use of printers in homes, businesses, governmental agencies, and various other organizations has increased significantly. Generally, each printer, or imaging apparatus, includes an imaging cartridge, such as an inkjet printhead cartridge or an electrophotographic cartridge. Such imaging cartridges typically have a finite life, and are produced in significant quantities to meet the printing demands of the various types of customers. Occasionally, problems occur in which a customer may observe erratic printing. In such cases, the customer may request technical support to seek resolution of the erratic printing, for example, from the manufacturer of the imaging cartridge.

In the past, determining the cause of failure of an imaging cartridge has been very difficult. When faced with a call from a customer who observes erratic print, service personnel often have difficulty determining the cause of the erratic print with only information from the customer's observations. For example, when the imaging cartridge begins to run out of ink or toner, the output of the imaging apparatus may become erratic. However, this same erratic behavior might also be due to various other failure modes of the imaging cartridge or the imaging apparatus. Therefore, it is difficult and sometimes impossible to determine the cause of erratic printing merely by observing a printed image. As a result, providing technical support to a customer is sometimes both time consuming and difficult, which may be frustrating to the customer.

What is needed in the art is an improved method and system for providing technical support relating to an imaging cartridge.

SUMMARY OF THE INVENTION

The present invention provides an improved method and system for providing technical support relating to an imaging cartridge.

The invention, in one form thereof, relates to a method for providing technical support to a customer relating to an imaging cartridge used in an imaging apparatus. The method includes receiving a request from the customer for assistance relating to the imaging cartridge; executing diagnostic software associated with a type of the imaging apparatus based on the request to generate a diagnostic code pertaining to the imaging cartridge; receiving the diagnostic code from the customer; performing an analysis of the diagnostic code; and determining an action to be taken based on the analysis of the diagnostic code.

The invention, in another form thereof, relates to a system for providing technical support to a customer relating to an imaging cartridge used in an imaging apparatus. The system includes a memory associated with the imaging cartridge, the memory storing diagnostics data. Diagnostic software associated with the type of the imaging apparatus executes to read the diagnostics data from the memory and generate a diagnostic code based thereon. Technical support software executes to perform an analysis of the diagnostic code, and determine an action to be taken based on the analysis of the diagnostic code.

The invention, in still another form thereof, relates to an imaging cartridge for use in an imaging apparatus. The imaging cartridge includes a colorant reservoir and a colorant dispersal unit coupled to the colorant reservoir. In addition, a memory is coupled to one of the colorant reservoir and the colorant dispersal unit. The memory stores diagnostics data from which a diagnostic code is derived and supplied to a technical support center.

An advantage of an exemplary embodiment of the present invention is an improvement in the accuracy of diagnosis of imaging cartridge failures.

Another advantage can be a reduction in the amount of time spent by both a customer and a technical support center in providing technical support relating to an imaging cartridge.

Yet another advantage of an embodiment of the present invention is that an Internet connection is not required between the customer and the technical support center in providing technical support and diagnosis of the imaging cartridge.

BRIEF DESCRIPTION OF THE DRAWINGS

The above-mentioned and other features and advantages of embodiments of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF EMBODIMENTS OF THE INVENTION

Figure 1:
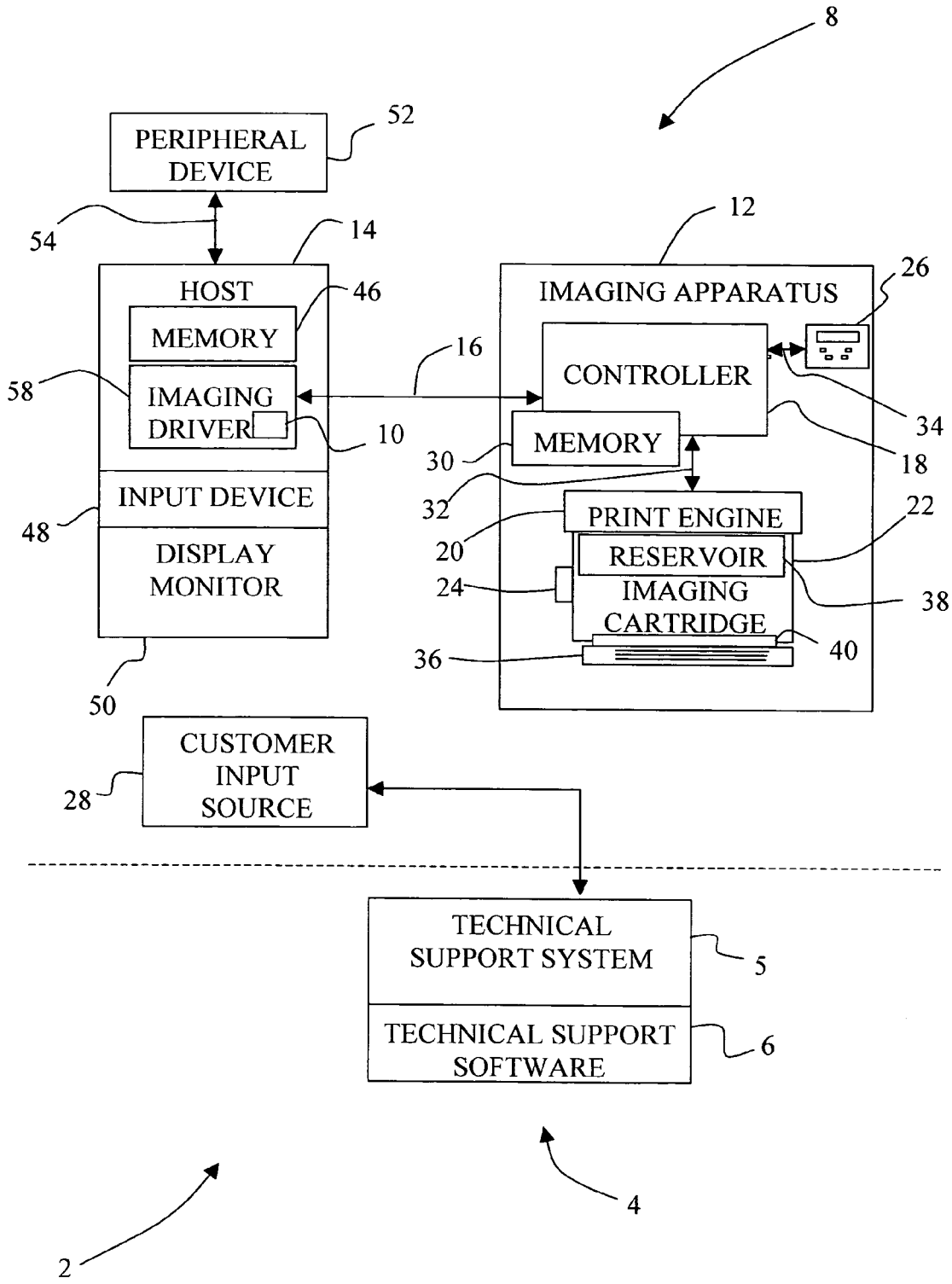
FIG. 1 is a diagrammatic depiction of a system for providing technical support in accordance with an embodiment of the present invention.

Referring now to the drawings, and particularly to FIG. 1, there is shown a diagrammatic depiction of a system 2 representing an embodiment of the present invention. System 2 is for providing technical support to a customer relating to an imaging cartridge used in an imaging apparatus. System 2 includes a technical support center 4 having a technical support system 5 accessing technical support software 6, and an imaging system 8 having diagnostic software 10. Technical support system 5 is to execute technical support software 6 in order to provide technical support. Technical support system 5 includes a computer having at least one input device, such as a keyboard and/or mouse, and a display monitor for displaying the output of technical support software 6.

In order to provide technical support for a customer, one or more of technical support centers 4 is provided, for example, by a manufacturer, distributor, and/or retailer of an imaging apparatus and/or an imaging cartridge. Technical support center 4 may be, for example, a conventional technical support center established by a manufacturer for use in supporting its products, a customer service department at a retailer, a warranty center, or the like. Alternatively, technical support center 4 may be a support center associated with, for example, a business or governmental entity. Technical support software 6 can be employed to provide technical support to a customer, and executes, for example, on a computer employed by technical support center 4.

Imaging system 8 includes an imaging apparatus 12 and a host 14. Imaging apparatus 12 communicates with host 14 via a communications link 16.

Imaging apparatus 12 may be, for example, an ink jet printer and/or copier, an electrophotographic printer and/or copier, or an all-in-one (AIO) unit that includes a printer, a scanner, and possibly a fax unit. Imaging apparatus 12 may be a stand alone imaging apparatus, a networked imaging apparatus having access to one or more local area networks, one or more intranets and/or the Internet, or may be any other dedicated or portable imaging apparatus. Imaging apparatus 12 includes a controller 18, a print engine 20, an imaging cartridge 22 having cartridge memory 24 associated therewith, and a user interface 26 that may be accessed by the customer in operating imaging apparatus 12.

The customer may be an individual purchaser, lessor, or user of imaging apparatus 12, or may be a business, governmental, or any organizational entity or user associated therewith that owns, leases, or otherwise operates imaging apparatus 12. The customer may contact technical support center 4 via a customer input source in the event a problem with imaging apparatus 12 and/or imaging cartridge 22 arises.

Customer input source 28 may be in the form of a telephone or network connection. Thus, the mode of communication between customer input source 28 and technical support center 4 may be via a telephone call, or via a network connection, whichever is most convenient to the customer. It will be noted, however, that a network connection is not required by the present invention, hence reducing the cost and complexity of providing technical support for the customer via technical support center 4. In addition, it will be noted that the customer may personally visit technical support center 4 as an acceptable mode of communication between the customer and technical support center 4 in providing technical support within the scope of the present invention.

Controller 18 is communicatively coupled to print engine 20, and print engine 20 is configured to mount imaging cartridge 22. Controller 18 includes a processor unit and associated memory 30, and may be formed as one or more Application Specific Integrated Circuits (ASIC). Controller 18 may be a printer controller, a scanner controller, or may be a combined printer and scanner controller. Although controller 18 is depicted in imaging apparatus 12, alternatively, it is contemplated that all or a portion of controller 18 may reside in host 14. Controller 18 communicates with print engine 20, imaging cartridge 22, and cartridge memory 24 via a communications link 32, and with user interface 26 via a communications link 34. Controller 18 serves to process print data and to operate print engine 20 during printing.

In the context of the examples for imaging apparatus 12 given above, print engine 20 may be, for example, an ink jet print engine or an electrophotographic print engine, configured for forming an image on a substrate 36, which may be one of many types of print media, such as a sheet of plain paper, fabric, photo paper, coated ink jet paper, greeting card stock, transparency stock for use with overhead projectors, iron-on-transfer material for use in transferring an image to an article of clothing, and back-lit film for use in creating advertisement displays and the like. As an ink jet print engine, print engine 20 operates imaging cartridge 22 to eject ink droplets onto substrate 36 in order to reproduce text or images, etc. As an electrophotographic print engine, print engine 20 causes imaging cartridge 22 to deposit toner onto substrate 36, which is then fused to substrate 36 by a fuser (not shown).

Imaging cartridge 22 includes a colorant reservoir 38 and a colorant dispersal unit 40. In the form of an ink jet printhead cartridge for use in an ink jet imaging apparatus 12, colorant reservoir 38 is in the form of an ink reservoir, which may be integral to imaging cartridge 22, or may be remotely mounted. Colorant dispersal unit 40, such as an inkjet printhead, is coupled to colorant reservoir 38, which ejects ink onto substrate 36. In the form of an electrophotographic cartridge for use in an electrophotographic machine, colorant reservoir 38 is in the form of toner reservoir. Colorant dispersal unit 40, which is coupled to colorant reservoir 38, is in the form of a toner delivery system for depositing toner on a photoconductive element that deposits toner onto substrate 36. In either case, however, cartridge memory 24 is directly or indirectly coupled to one of colorant reservoir 38 and colorant dispersal unit 40, and stores diagnostics data 66 from which diagnostic code 68 is derived and supplied to technical support center 4.

Imaging cartridge 22 may refer to one or more distinct imaging cartridges employed by imaging apparatus 12 in forming an image on substrate 36. Imaging cartridge 22 may be, for example, one or more of a mono-color imaging cartridge, such as a black imaging cartridge, a color imaging cartridge, or a photo-quality imaging cartridge.

Host 14 may be, for example, a personal computer, including memory 46, an input device 48, such as a keyboard, and a display monitor 50. A peripheral device 52, such as a digital camera, is coupled to host 14 via a communications link 54. Host 14 further includes a processor, input/output (I/O) interfaces, and may be connected to a network. Memory 46 may be any or all of RAM, ROM, NVRAM, or any available type of computer memory, and may include one or more of a mass data storage device, such as a floppy drive, a hard drive, a CD-ROM and/or a DVD unit.

During operation, host 14 includes in its memory 46 a software program including program instructions that function as an imaging driver 58, e.g., printer/scanner driver software, for imaging apparatus 12. Imaging driver 58 is in communication with controller 18 of imaging apparatus 12 via communications link 16. Imaging driver 58 facilitates communication between imaging apparatus 12 and host 14, and provides formatted print data to imaging apparatus 12, and more particularly, to print engine 20, for use in printing with imaging cartridge 22. Although imaging driver 58 is disclosed as residing in memory 46 of host 14, it is contemplated that, alternatively, all or a portion of imaging driver 58 may be located in controller 18 of imaging apparatus 12.

Diagnostic software 10 is associated with the type of imaging apparatus 12, for example, the model of imaging apparatus 12. Diagnostic software 10 may reside in memory 30 and/or imaging driver 58 associated with imaging apparatus 12. For example, in the embodiment depicted in FIG. 1, diagnostic software 10 is depicted as residing in imaging driver 58. Alternatively, however, it is contemplated that diagnostic software 10 is accessed via a web page associated with imaging apparatus 12, for example, via an embedded server of imaging apparatus 12, or an Internet or intranet site.

Diagnostics data 66, stored in cartridge memory 24 of imaging cartridge 22, can be provided in conjunction with diagnostic software 10 to provide technical support center 4 with a diagnostic code 68. Diagnostic code 68 may then be analyzed at technical support center 4 in order to best determine a course of action with respect to the concern of the customer regarding imaging apparatus 12 and/or imaging cartridge 22.

Accordingly, diagnostics data 66 is used by technical support center 4 in remotely diagnosing problems with imaging apparatus 12 and/or imaging cartridge 22. Diagnostic software 10 executes to read diagnostics data 66 from cartridge memory 24, and generate diagnostic code 68 based thereon. Technical support system 5 is configured to perform an analysis of diagnostic code 68, and to determine an action to be taken based on the analysis of diagnostic code 68, by executing technical support software 6.

Figure 2:
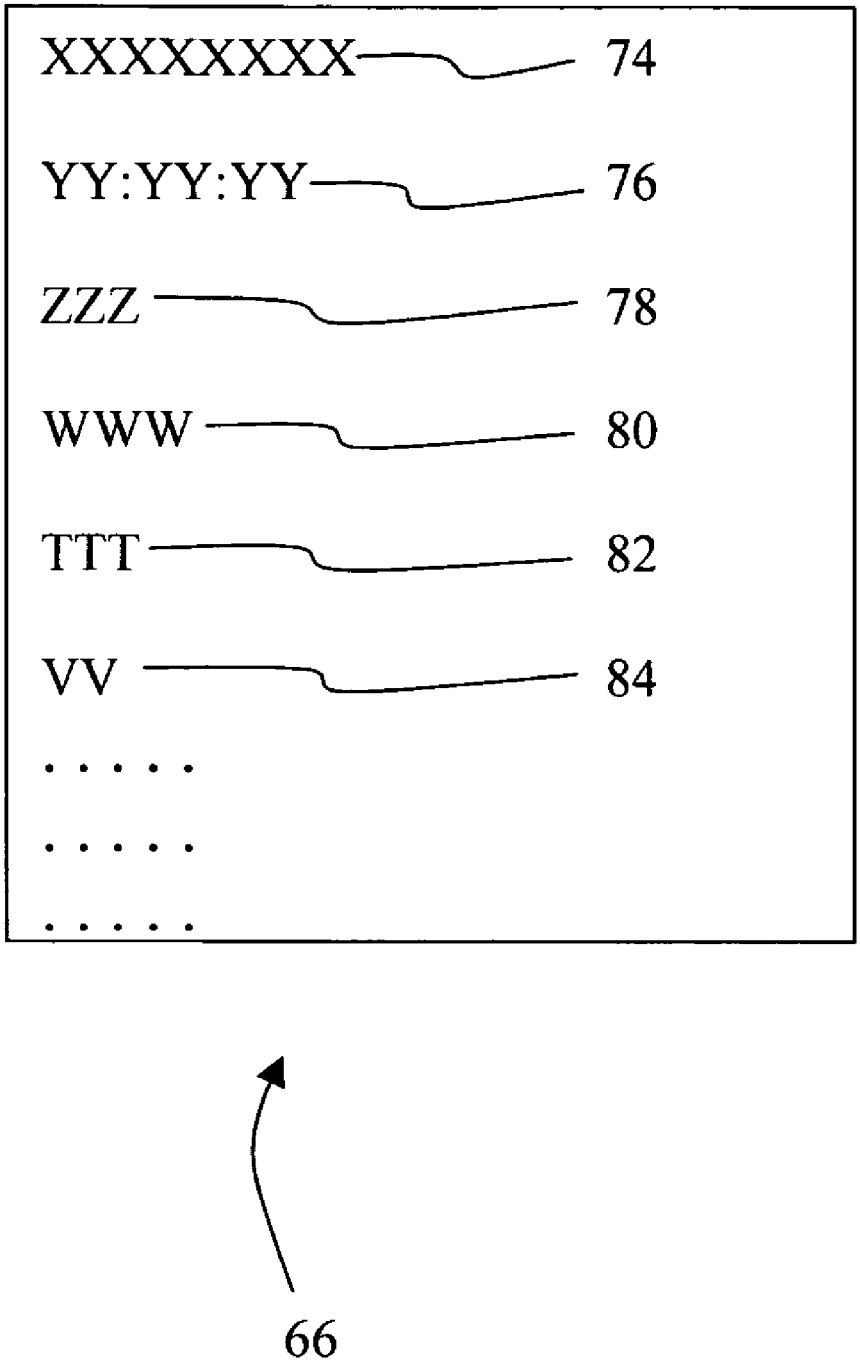
FIG. 2 is a graphical illustration of diagnostic data stored in an imaging cartridge memory in accordance with an embodiment of the present invention.

Referring now to FIG. 2, a graphical illustration of diagnostic data 66 stored in cartridge memory 24 is depicted. Diagnostic code 68 is based on diagnostics data 66 stored in cartridge memory 24 associated with imaging cartridge 22. Diagnostics data 66 includes a serial number 74 of imaging cartridge 22, which is associated with the manufacturing lot of imaging cartridge 22. Thus, if a manufacturing lot were known to be problematic, the action determined by technical support software 6 may be to replace imaging cartridge 22, e.g., under warranty, based on knowing the manufacturing lot of imaging cartridge 22 to be problematic.

Diagnostics data 66 also includes at least one of, but preferably most or all of, a time 76 since imaging cartridge 22 was first installed in any imaging apparatus, a colorant consumption parameter 78, a colorant decay characteristic 80 of imaging cartridge 22, a cartridge kind identifier 82, and a cartridge use identifier 84.

Time 76 is employed, for example, in determining whether imaging cartridge 22 is still under warranty, and may include the manufacturing date of imaging cartridge 22. In addition, time 76 is used by technical support software 6 in determining an expected amount of degradation of the colorant.

Colorant consumption parameter 78 pertains to the amount of consumption of the colorant based on, for example, the number of pixels, or dots, printed by imaging cartridge 22.

If the colorant is ink, colorant decay characteristic 80 is in the form of an evaporation characteristic of the ink for the particular type or model of imaging cartridge 22, and is used by technical support software 6 in conjunction with time 76 in determining whether evaporative loss of the ink may result in improper functioning of colorant dispersal unit 40 in the form of an inkjet printhead, e.g., due to viscosity effects. Similarly, if the colorant is toner, colorant decay characteristic 80 may pertain, for example, to the moisture content of the toner, which may increase with respect to time due to ambient humidity.

Cartridge kind identifier 82 is an identification parameter for imaging cartridge 22, and may identify whether imaging cartridge 22 is a color, black, or a photo quality imaging cartridge, as well as the colorant capacity of the cartridge, e.g., standard, high-yield, or moderate-yield capacity. Cartridge kind identifier may be employed by technical support software 6 in determining whether imaging cartridge 22 is installed in the wrong position in imaging apparatus 12. For example, a color-imaging cartridge 22 may have been installed by the customer in a position designation for a black imaging cartridge 22. In addition, cartridge kind identifier 82 may be used by technical support software 6 in conjunction with colorant consumption parameter 78 to determine whether imaging cartridge 22 is out of colorant, for example, by comparing the amount of colorant consumed, indicated by colorant consumption parameter 78, with the colorant capacity of imaging cartridge 22.

Cartridge use identifier 84 is an identification parameter that indicates which type of imaging apparatus imaging cartridge 22 may be used in. Thus, cartridge use identifier 84 allows a determination by technical support software 6 of whether imaging cartridge 22 an invalid type of imaging cartridge for the type of imaging apparatus 12 in which it is installed. For example, imaging cartridge 22 may be designed to operate in another type of imaging apparatus manufactured by the manufacturer of imaging apparatus 12 than that in which the customer may have installed it.

Diagnostic code 68 also includes diagnostic information pertaining to imaging apparatus 12, for example, the type, i.e., model, of imaging apparatus 12. This diagnostic information is used in conjunction with cartridge kind identifier 82 and cartridge use identifier 84 by technical support system 5, executing technical support software 6, in making the aforementioned determinations.

Figure 3:
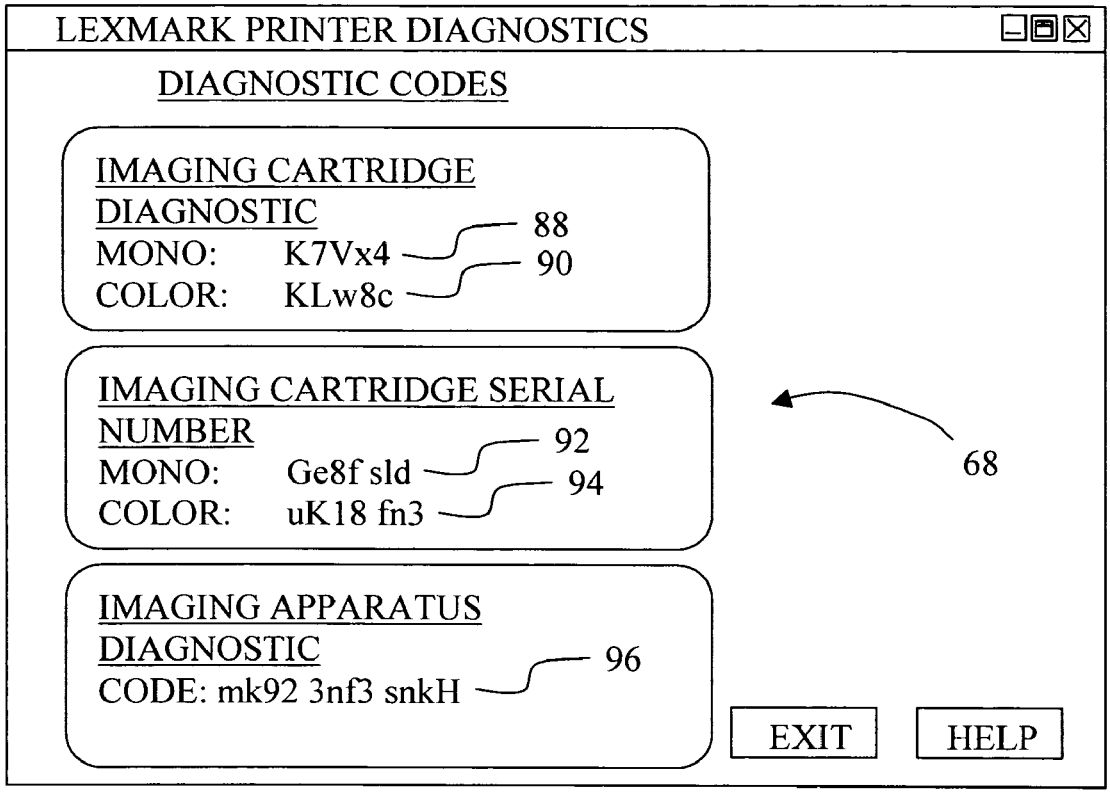
FIG. 3 depicts a diagnostic screen having a diagnostic code based on the diagnostic data of FIG. 2.
Figure 3:
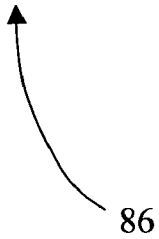

Referring now to FIG. 3, a diagnostic screen 86 generated by diagnostic software 10 on display monitor 50 of host 14 is depicted. Diagnostic code 68 is depicted as a multi-part diagnostic code intended to be employed by technical support software 6 in providing technical support for the customer. Accordingly, diagnostic code 68 includes diagnostic sub-code 88 and diagnostic sub-code 90 pertaining to, for example, black and color imaging cartridges 22, respectively. Diagnostic sub-code 92 and diagnostic sub-code 94 pertain to the serial numbers of black and color imaging cartridges 22, respectively, and diagnostic sub-code 96 pertains to the diagnostic code for imaging apparatus 12.

Technical support system 5 executes technical support software 6 at technical support center 4 to perform the analysis, for example, in response to a request for assistance from the customer. Technical support system 5 executes technical support software 6 to convert diagnostic code 68 into diagnostic data 66 that is in a human-readable form. Diagnostic data 66 may then be read by a technical support center 4 operator, e.g., service personnel or another machine or human entity that communicates with the customer in order to provide technical support to the customer.

Figure 4A:
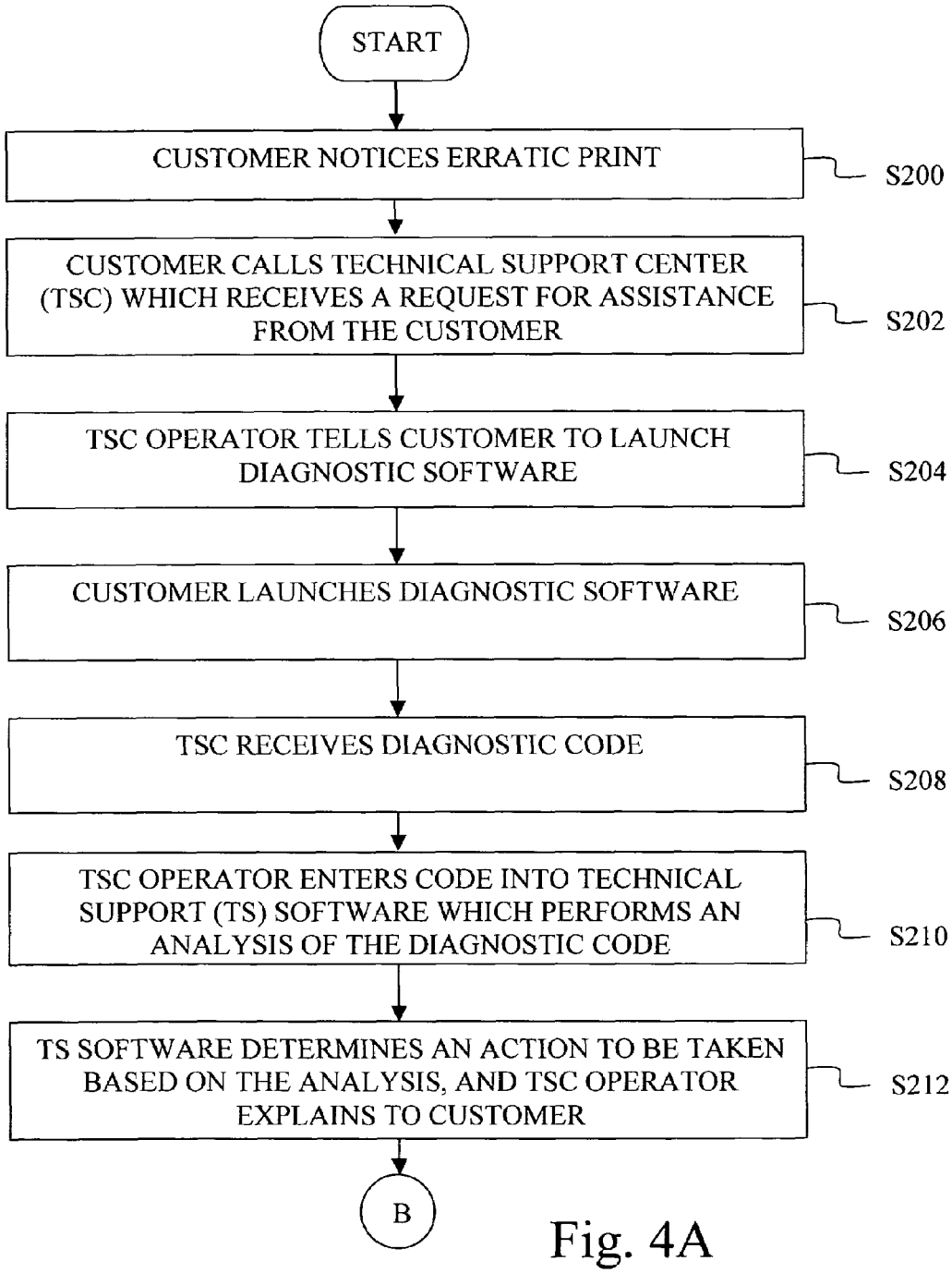
FIGS. 4A and 4B is a flowchart depicting an embodiment of a method for providing technical support to a customer in accordance with the present invention.
Figure 4B:
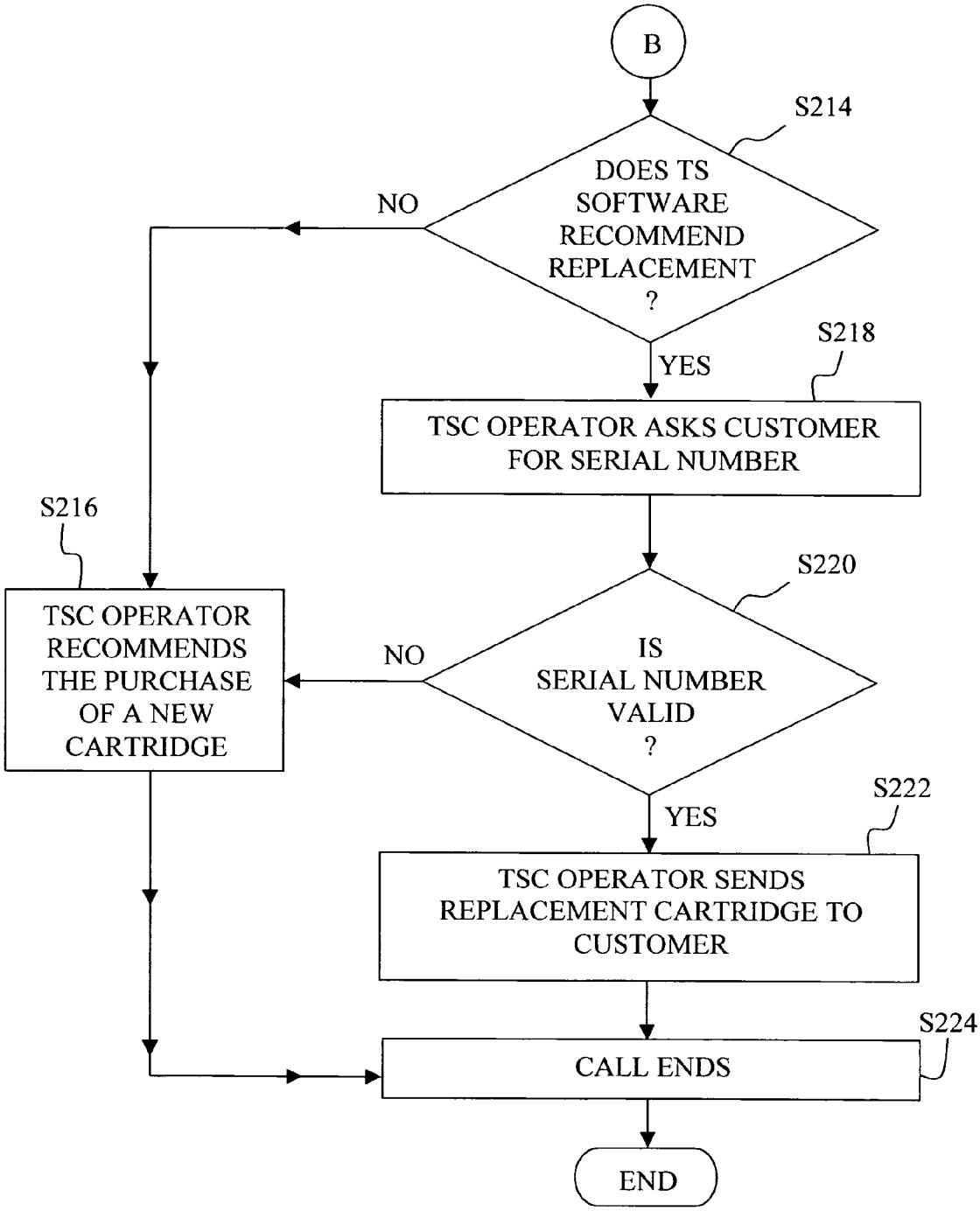

Referring now to FIGS. 4A and 4B, a method for providing technical support to a customer relating to an imaging cartridge used in an imaging apparatus is depicted in the form of a flowchart.

As shown in FIG. 4A, at step S200, the customer notices erratic print output by imaging apparatus 12 using imaging cartridge 22.

At step S202 the customer calls technical support center 4, which receives a request from the customer for assistance relating to imaging cartridge 22. Alternatively, the customer may visit technical support center 4 in person, or may access technical support center 4 via the Internet or an intranet. The request from the customer is based on a perceived failure of imaging apparatus 12 and/or imaging cartridge 22 by the customer, e.g., due to the erratic print observed by the customer.

At step S204, a technical support center 4 operator solicits the customer to initiate, or launch, diagnostic software 10.

At step S206, the customer executes diagnostic software 10 to generate diagnostic code 68 pertaining to imaging cartridge 22. In the embodiment depicted, the execution of diagnostic software 10 is initiated by the customer in response to a solicitation received from technical support center 4, based on the request of the customer for assistance. Alternatively, it is contemplated that the customer may initiate execution of diagnostic software 10 prior to contacting technical support center 4, or prior to being solicited to do so by the operator at technical support center 4.

At step S208, technical support center 4 receives diagnostic code 68 from customer, for example, by the customer reading diagnostic code 68 to the operator at technical support center 4.

At step S210, the technical support center 4 operator enters diagnostic code 68 into technical support software 6, which performs an analysis of diagnostic code 68.

At step S212, technical support software 6 determines an action to be taken based on the analysis of diagnostic code 68, including determining whether to replace imaging cartridge 22, and explains the problem pertaining to the erratic print to the customer based on the analysis. The action to be taken is at least partially based on a warranty period, i.e., whether or not imaging apparatus 12 and/or imaging cartridge 22 is still under warranty. The analysis includes determining whether imaging cartridge 22 is an invalid type of imaging cartridge for use in imaging apparatus 12, for example, based on cartridge use identifier 84. The analysis also includes determining whether imaging cartridge 22 was installed in a wrong position in imaging apparatus 12, for example, a color imaging cartridge installed in a black imaging cartridge position, based on cartridge kind identifier 82.

In addition, the analysis includes at least: determining whether imaging cartridge 22 is out of colorant, i.e., colorant reservoir 38 is low on or empty of colorant, based on colorant consumption parameter 78; determining whether the colorant is no longer usable, based on colorant decay characteristic 80; determining whether imaging cartridge 22 is under warranty, based on time 76; determining if colorant dispersal unit 40 is not functioning properly, for example, based on the absence of diagnostic data for imaging cartridge 22 and imaging apparatus 12 that indicates another cause of the problem reported by the customer; and determining a usage rate 98 of imaging cartridge 22, e.g., the amount of colorant used in proportion to time 76 when imaging cartridge 22 was first installed.

Referring now to FIG. 4B, at step S214 the technical support center 4 operator determines whether technical support software 6 recommends the action of replacement of imaging cartridge 22. If not, process flow proceeds to step S216. If so, process flow proceeds to step S218.

Figure 5:
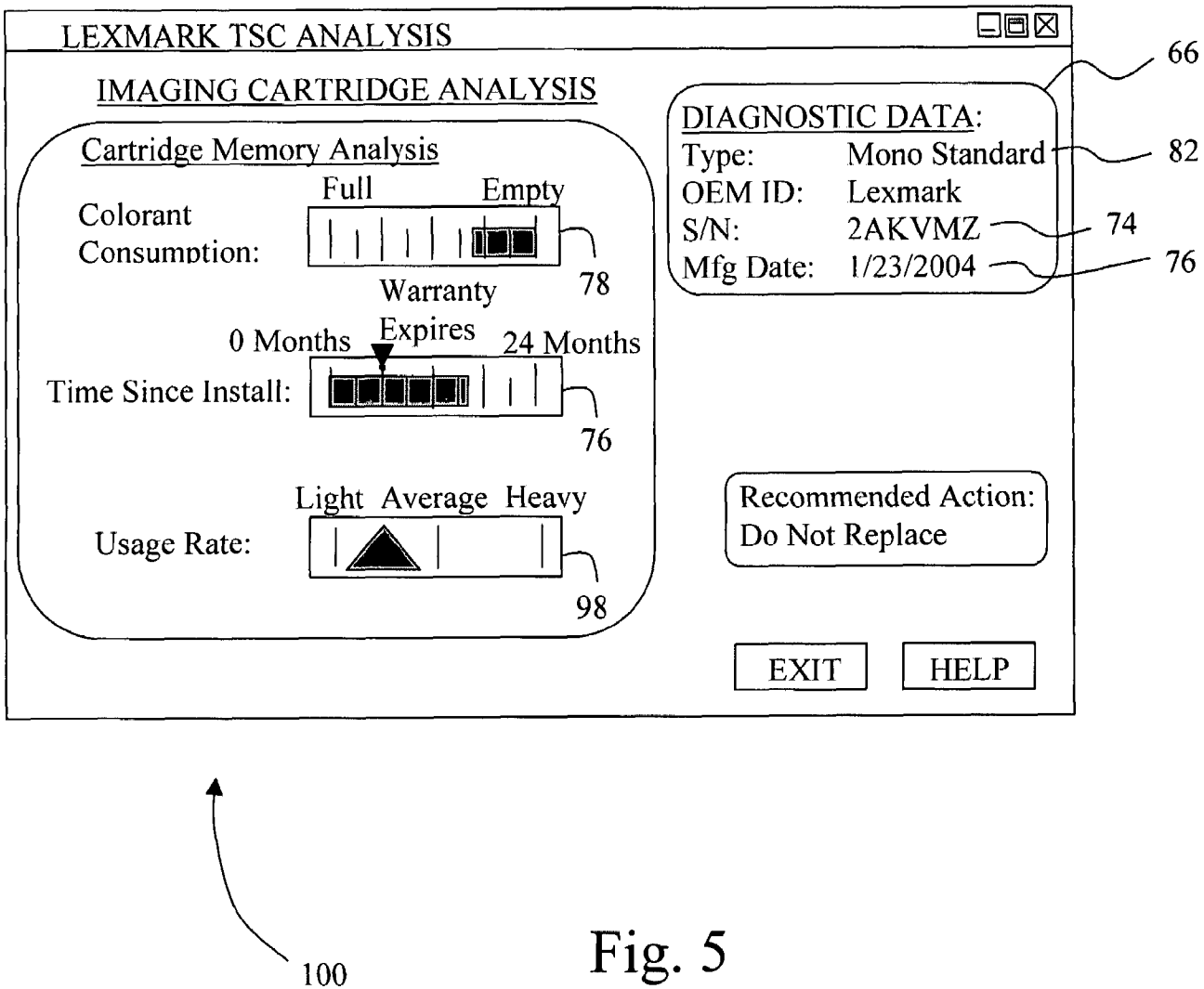
FIG. 5 is depicts an analysis screen showing the results of an exemplary analysis of a diagnostic code in accordance with the embodiment of FIGS. 4A and 4B.

For example, with reference to FIG. 5, an analysis screen 100 generated by technical support software 6 is depicted. Colorant consumption parameter 78 in illustrated the form of a gas gauge, and indicates that there is colorant is remaining in colorant reservoir 38. However, time 76 indicates that imaging cartridge 22 is substantially out of warranty, and thus technical support software 6 does not recommend replacement of imaging cartridge 22.

Figure 6:
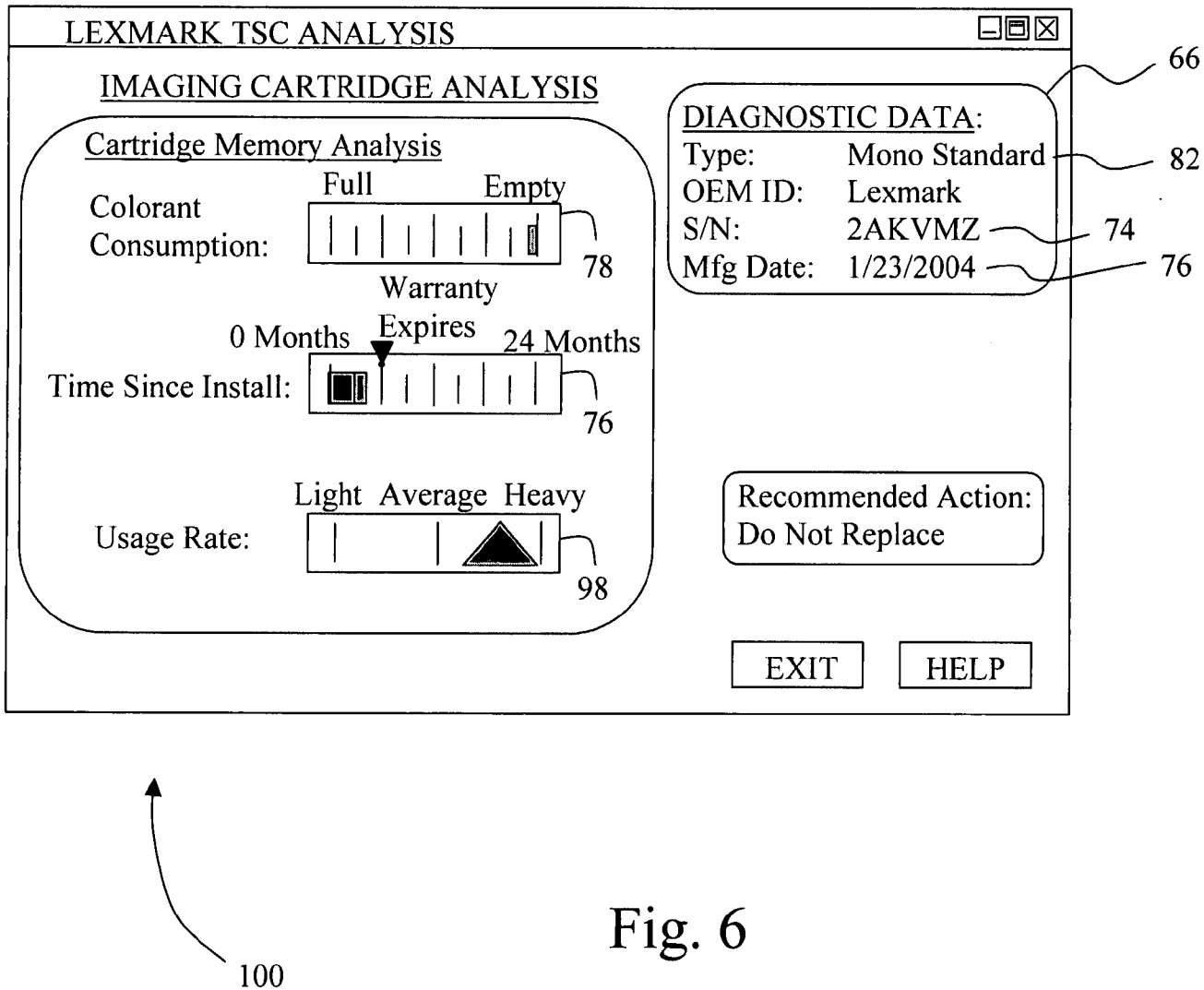
FIG. 6 is depicts the results of another exemplary analysis of a diagnostic code in accordance with the embodiment of FIGS. 4A and 4B.

Referring now to FIG. 6, imaging cartridge 22 is still under warranty, but due to the heavy usage of imaging cartridge 22, as indicated by usage rate 98, colorant reservoir 38 is empty or nearly so, which explains the erratic printing. In such a case, the action determined by technical support software 6 may include providing an economic incentive to the customer to replace imaging cartridge 22 based on a rate of usage of imaging cartridge 22, although a warranty replacement is not recommended.

Figure 7:
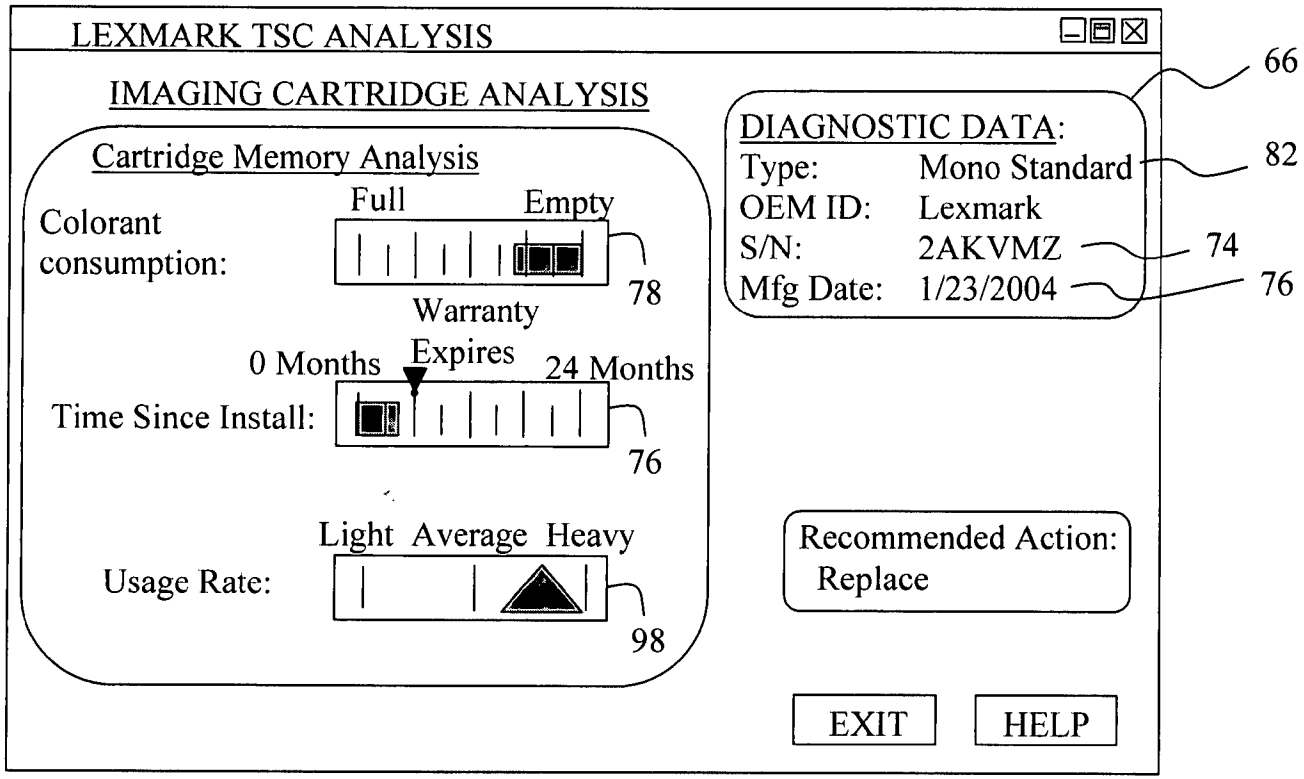
FIG. 7 is depicts an analysis screen showing the results of still another exemplary analysis of a diagnostic code in accordance with the embodiment of FIGS. 4A and 4B.

Referring now to FIG. 7, colorant consumption parameter 78 indicates that colorant reservoir 38 is not empty or even nearly so. However, since time 76 indicates that cartridge 22 is under warranty, technical support software 6 recommends replacing imaging cartridge 22.

Figure 8:
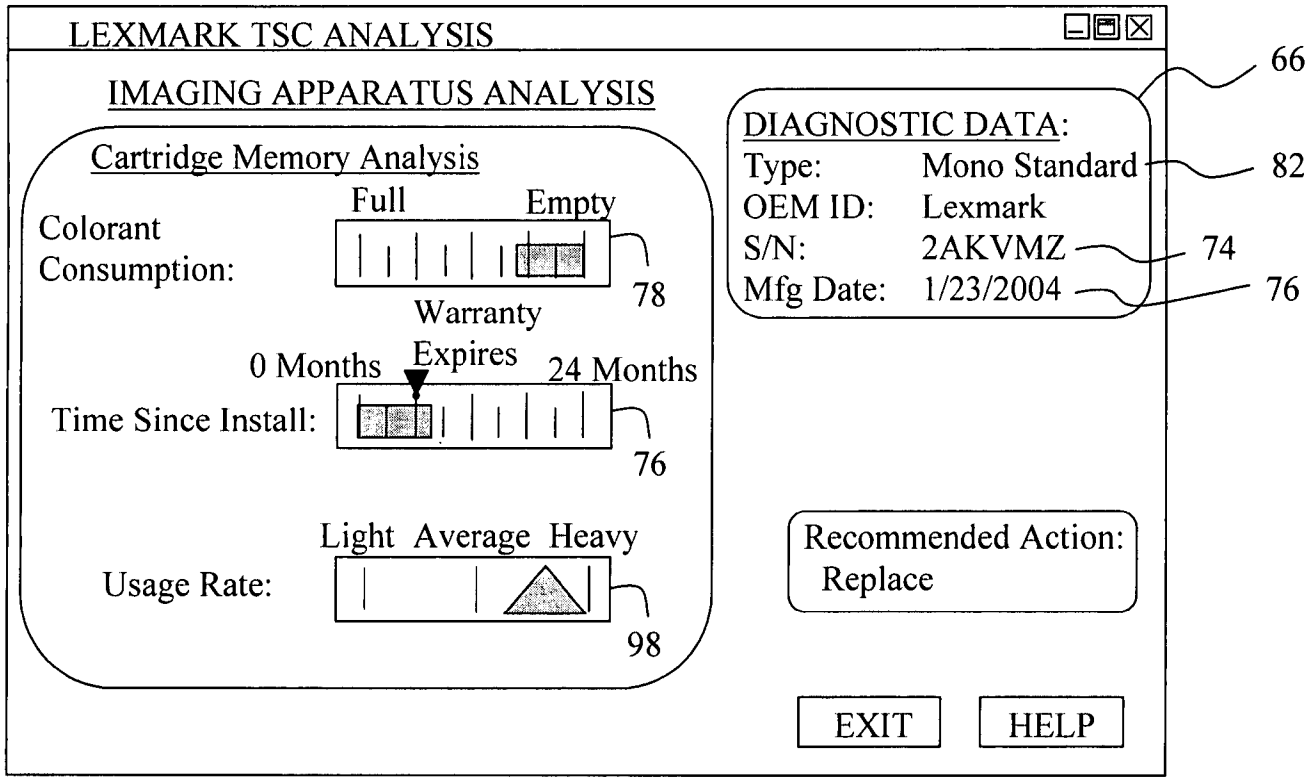
FIG. 8 is depicts an analysis screen showing the results of yet another exemplary analysis of a diagnostic code in accordance with the embodiment of FIGS. 4A and 4B.

Referring now to FIG. 8, colorant consumption parameter 78 indicates that colorant is remaining in colorant reservoir 38, and time 76 indicates that imaging cartridge 22 is slightly out of warranty. In such a case, technical support software 6 may be configured to recommend replacement of imaging cartridge 22 to ensure the loyalty of a customer.

Referring again to FIG. 4B, at step S216, the technical support center 4 operator recommends that the customer purchases a new imaging cartridge 22, for example, in the case that there is no problem with imaging apparatus 12 or imaging cartridge 22, but rather, all the colorant in imaging cartridge 22 has been used up, thus causing the erratic print observed by the customer.

At step S218, the technical support center 4 operator asks the customer for serial number 74 and a security code stored in cartridge memory 24 of imaging cartridge 22 to determine whether imaging cartridge 22 may properly be replaced by or on behalf of technical support center 4. For example, if imaging cartridge 22 was not manufactured or sold by the entity that owns or operates technical support center 4, imaging cartridge 22 may not properly be replaced via technical support center 4.

At step S220, the technical support center 4 operator determines whether serial number 74 is valid, i.e., that imaging cartridge 22 may properly be replaced via technical support center 4. If so, process flow proceeds to step S222, otherwise, process flow proceeds to step S216, wherein the technical support center 4 operator recommends that the customer purchases a new imaging cartridge 22.

At step S222, the technical support center 4 operator initiates a course of action to send a replacement imaging cartridge 22 to the customer. Alternatively, the technical support center 4 operator may send a coupon for replacement of imaging cartridge 22, for example, via mail, or electronically.

At step S224, the call from the customer to technical support center 4 ends.

From the above description, it will be understood that embodiments of the present invention may improve the accuracy of diagnosis of apparent imaging cartridge failures, for example, by differentiating between a true failure and an imaging cartridge 22 that is merely emptied of colorant. In addition, the amount of time spent by both the customer and technical support center 4 in providing technical support relating to imaging cartridge 22 may be reduced. For example, once the customer provides diagnostic code 68 to technical support center 4, a lengthy description of the customer's observations of erratic printing may not be required. Further, an embodiment of the present invention does not require an Internet connection between the customer and technical support center 4 in order to provide technical support and diagnosis of imaging cartridge 22, thus allowing diagnosis of imaging cartridge 22 for those customers who choose not to obtain technical support via the Internet, or who may not have an Internet connection.

While this invention has been described with respect to exemplary embodiments, it will be recognized that the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for providing technical support to a customer relating to an imaging cartridge used in an imaging apparatus, comprising:

turning on said imaging apparatus;

receiving by a technical support center a request from said customer for assistance relating to said imaging cartridge;

executing diagnostic software associated with a type of said imaging apparatus based on said request to generate a diagnostic code pertaining to said imaging cartridge;

receiving said diagnostic code from said customer;

performing an analysis of said diagnostic code; and determining an action to be taken based on said analysis of said diagnostic code.

2. The method of claim 1, wherein said executing said diagnostic software is initiated by said customer.

3. The method of claim 1, wherein said executing said diagnostic software is initiated by said customer in response to a solicitation received from a technical support center.

4. The method of claim 1, wherein said diagnostic software resides in one of a memory of said imaging apparatus and an imaging driver associated with said imaging apparatus.

5. The method of claim 1, wherein said diagnostic software is accessed via a web page associated with said imaging apparatus.

6. The method of claim 1, wherein said request from said customer is based on a perceived failure of said imaging cartridge by said customer.

7. The method of claim 1, wherein said determining said action includes determining whether to replace said imaging cartridge.

8. The method of claim 7, wherein said action is based on a warranty period.

9. The method of claim 7, wherein said action includes providing an economic incentive to said customer to replace said imaging cartridge based on a rate of usage of said imaging cartridge.

10. The method of claim 7, wherein said diagnostic code is based on diagnostics data stored in a memory associated with said imaging cartridge.

11. The method of claim 10, wherein said diagnostics data includes a serial number of said imaging cartridge, and wherein said action is based on a manufacturing lot of said imaging cartridge.

12. The method of claim 10, wherein said diagnostics data includes at least one of a time since said imaging cartridge was installed in any imaging apparatus, a colorant consumption value, a colorant decay characteristic of said imaging cartridge, a cartridge kind identifier, and a cartridge use identifier.

13. The method of claim 1, wherein said analysis is performed by technical support software operated by a technical support center.

14. The method of claim 13, wherein said analysis includes determining whether said imaging cartridge is an invalid type of imaging cartridge for said imaging apparatus.

15. The method of claim 13, wherein said analysis includes determining whether said imaging cartridge was installed in a wrong position in said imaging apparatus.

16. The method of claim 13, wherein said analysis includes determining whether a colorant reservoir of said imaging cartridge is empty.

17. The method of claim 13, wherein said analysis includes determining whether a colorant is no longer usable.

18. The method of claim 13, wherein said analysis includes determining whether said imaging cartridge is under a warranty.

19. The method of claim 13, wherein said analysis includes determining if a colorant dispersal unit is not functioning properly.

20. The method of claim 13, wherein said analysis includes determining a usage rate of said imaging cartridge.

* * * * *